United States Patent [19]

Barrett

[11] Patent Number: 4,877,238

[45] **Date of Patent: * Oct. 31, 1989**

[54] SWING EXERCISER

[76] Inventor: Arthur L. Barrett, 651 Espanita St., Long Beach, Calif. 90815

[ * ] Notice: The portion of the term of this patent subsequent to Aug. 16, 2005 has been disclaimed.

[21] Appl. No.: 229,122

[22] Filed: Aug. 5, 1988

Related U.S. Application Data

[63] Continuation-in-part of Ser. No. 40,375, Apr. 20, 1987, Pat. No. 4,763,894.

[51] Int. Cl.[4] ..... A63B 1/00; A63G 9/00

[52] U.S. Cl. ..... 272/70; 272/85; 297/274

[58] Field of Search ..... 272/109, 85, 70 A, 70.3, 272/70.4, 92, 70; 297/274, 275, 5; 182/3, 6, 7; D6/347, 386, 387; 244/151 R; 224/161, 158

[56] References Cited

U.S. PATENT DOCUMENTS

| | | | |
|---|---|---|---|
| 450,394 | 4/1891 | Billeaux | 297/275 |
| 2,852,066 | 9/1958 | Hawkins | 182/3 |
| 4,017,071 | 4/1977 | Wright | 272/85 |
| 4,763,894 | 8/1988 | Barrett | 272/70 |

*Primary Examiner*—S. R. Crow

*Attorney, Agent, or Firm*—Plante Strauss Vanderburgh

[57] ABSTRACT

There is disclosed an infant sling which is formed as a generally U-shaped band of flexible sheet material having its upper ends attached to a support. The support can be a vest worn by an adult to provide an infant carrier, or can be a support ring which is suspended from a supporting structure to provide an infant swing. The support ring has substantially the same diameter as the lateral dimensions of the infant. The support ring protects the infant's head, and supports the sides of the sling vertically and substantially parallel to each other, totally enclosing the sides of the infant. The sling also includes a back support band which extends vertically from the support ring to a joined attachment with the fabric band of the sling at its lower rear edges, and has front belting which extends about the waist or diagonally across the chest and lower abdomen of the infant. The sling has a pair of leg openings at its lower end, or bight, and the sides have opposite openings for the arms of the infant.

16 Claims, 4 Drawing Sheets

SWING EXERCISER

RELATION TO OTHER APPLICATIONS

This application is a continuation in part of parent application Ser. No. 40,375, filed Apr. 20, 1987, now U.S. Pat. No. 4,763,894.

FIELD OF INVENTION

This invention relates to a carrier and swing for an infant, and, in particular, to an infant exerciser with improved safety features which is convertible to an infant carrier.

BACKGROUND ART

Infant exercisers have been available for a number of years. Commonly these exercisers have a saddle, seat, or sling which is supported much like a swing from a bracket which is clamped to the jamb in a doorway or to an overhead beam. U.S. Pat. No. 2,868,292 discloses a typical structure which has been marketed under the trade designation Johnny Jump Up. In this device, the swing ropes are held apart by a lateral cross bar. Other commercially available exercisers are known as the "Hop Skip Jumper", and the "Jolly Jumper" in which a molded plastic bucket or seat is provided for the infant.

The devices which have heretofore been provided are not entirely safe and can lead to accidents. In some of the prior exercisers, the infant is not securely fastened and can fall out of the device. In other exercisers, the device can tilt or topple, suspending the infant upside down and leading to injuries. The devices which are formed of a rigid plastic seat have rigid edges which can bump against the door jambs resulting in finger and hand injury to the infant when the infant grasps the sides of the seat. In none of the devices has there been any provision for substantially totally enclosing the upper torso and head of the infant, particularly the sides and back of the upper torso and head.

All of the prior devices have been marketed solely for infants, and their designs and structures limit their use to infant exercisers. These devices, however, have a potential market as exercisers in other applications, e.g., as physical therapy aids for injured and partially paralyzed children and adults, and as strenuous activity exercisers. For use in such applications as well as for use as infant exercisers, the exerciser should be designed with safety features which are lacking in the current products.

BRIEF DISCLOSURE OF THE INVENTION

This invention comprises an exerciser swing, which preferably is convertible to an infant carrier. The swing includes a sling and a supporting frame. The sling is formed as a generally U-shaped band of flexible sheet material having its upper ends attached to a ring of the supporting frame which has substantially the same diameter as the lateral dimensions of the user. The support ring thereby provides protection for the user's head, and supports the sides of the sling vertically and substantially parallel to each other, totally enclose the sides of the user. Preferably, the sling is detachable from the supporting ring and can thus function as an infant carrier when attached to a vest worn by an adult. The sling includes a back support band which extends vertically from its upper edges and attaches to the fabric band of the sling at its lower rear edges. The sling assembly includes front belting which extends about the infant's waist or, preferably, as a pair of crossed bands that extend diagonally across the chest and lower abdomen of the infant. The sling has a pair of leg openings at its lower end, or bight, and the sides have opposite openings for the arms of the infant. The resulting structure provides a safe, substantially total enclosure for the upper torso and head of the infant, yet the infant's feet and hands are permitted full freedom of movement, allowing the infant to utilize the exerciser capabilities to a maximum extent. The sling provides a comfortable support which is distributed over the entire body of the infant, thus minimizing stress to the infant's pelvis.

BRIEF DESCRIPTION OF THE DRAWINGS

The invention will be described with reference to the FIGURES of which.

DESCRIPTION OF THE PREFERRED EMBODIMENT

Figure 1:
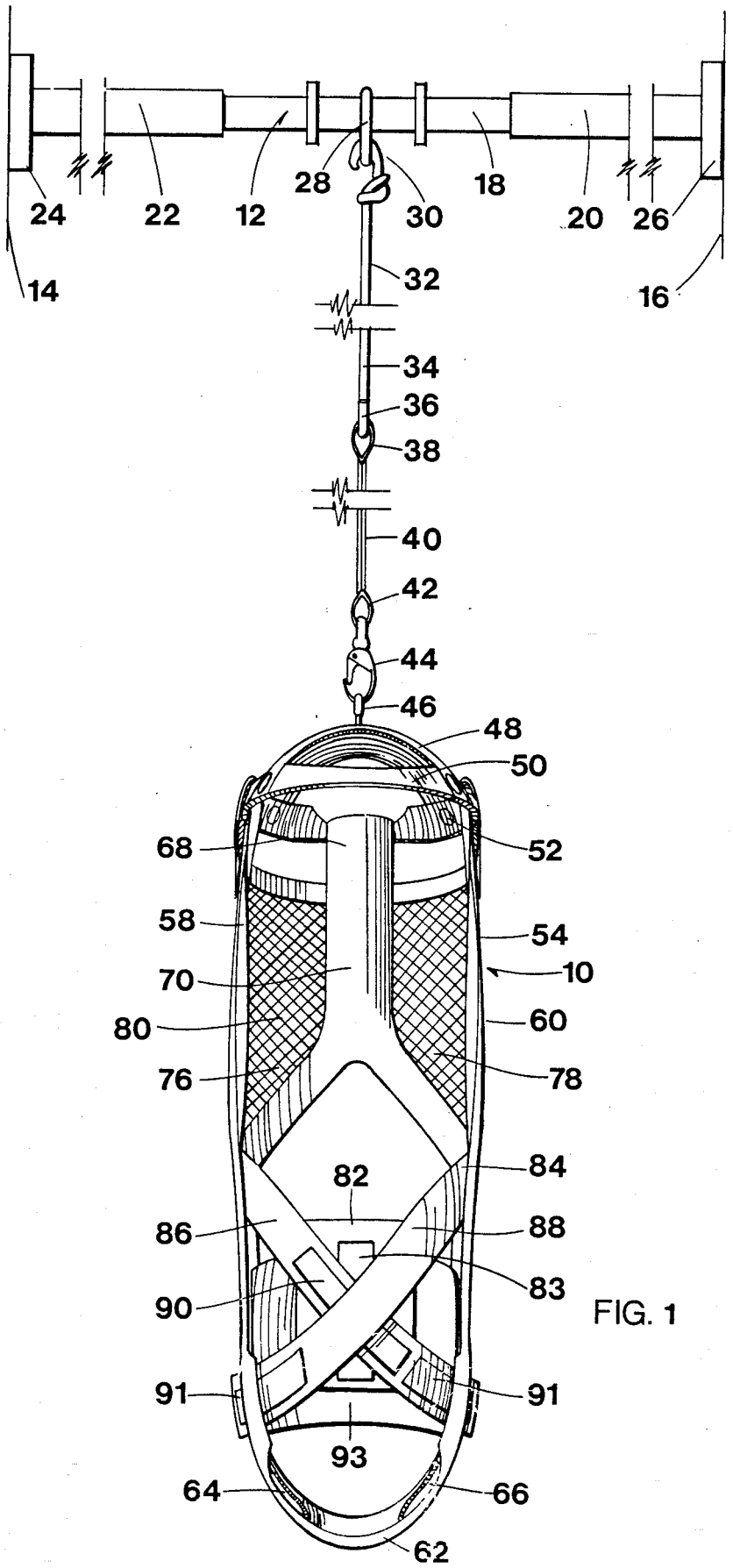
FIG. 1 is a front view of the preferred embodiment of the exerciser of the invention.

FIG. 1 illustrates the swing exerciser 10 of the invention as supported from a beam 12 which extends between opposite facing vertical surfaces 14 and 16. The beam 12 is preferably a telescoping or expandable assembly of a central tubular member 18 received within outer tubular members 20 and 22 that are distally secured to the central tubular member 18. The members can be secured together by suitable means, preferably by threaded engagement whereby the end plates 24 and 26 which are distally carried by each of the outer members 20 and 22 can be compressively secured against the vertical surfaces 14 and 16. For this purpose, the threaded engagements of the opposite outer tubular members can have threads of opposite direction, i.e., right and left had threads such that rotation of the inner tubular member 18 will expand or contract the assembly.

Centrally positioned on the inner tubular member 18 is a support bracket 28 having an aperture to receive a hook 30. The hook 30 is secured to the upper end 32 of a support strap 34 which terminates in a lower end loop 36. The loop 36 is received within a similar loop 38 of the successive strap 40 that has a lower loop 42 which receives a hook 44 that is attached to a central support 46 of an elastomeric disk 48. Preferably, hook 44 has aperture in its lower end 45 which receives a pin from buckle 47 in a swivel connection.

In this application, strap 40 can be non-elastic. If desired, however, one or both of straps 40 and 34 can be elastic, to provide a greater resilient lift or "bouncing" action to the assembly than that provided by the elastomeric disk 48, alone. The disk 48 is deformed into an arcuate shape with its edges received within a cylindrical ring 50. Preferably, the outer edges of the disk are permanently attached to the ring 50, and for this purpose any suitable permanent attachment means can be used such as cementing or mechanical fasteners such as rivets 52 can be used. The ring 50 serves as the upper support member of the sling 54 which is formed by a band 56 having a U-shape with its upper ends 58 and 60 permanently secured to opposite sides of the support ring 50. The band 56 thus forms sling 54 with substantially parallel sides and a lowermost bight 62. Two leg openings 64 and 66 are provided in the bight 62 of the sling 54 and openings are provided (not shown in FIG. 1) intermediate the length of the sides to provide opposite arm openings.

A back support 68 in the form of a substantially vertical band 70 extends downwardly from the back side of the support ring 50 and into a joined attachment at the lower rear edges 72 and 74 (see FIG. 2) of the sides. Preferably, the spaces 76 and 78 between the back strap 68 and the rear edges of the sides is filled with a flexible and transparent support such as netting 80. A lower lumbar support is also provided in the form of a pad 93 which, preferably, is removably supported in the lower lumbar portion of the sling.

The sling 54 also includes front belting 84 to secure the infant in the sling. This preferably comprises a pair of straps 86 and 88 which are permanently secured at one of their ends to the respective opposite sides of the sling assembly and have attachment means in the form of fabric attachment bands 91 at their opposite ends for the removable attachment to the sides. This is provided by passing the free ends of the straps 86 and 88 through the leg openings 64 and 66. A coacting attachment fabric is lined on the inside surface of the sling adjacent the leg openings 64 and 66 to coact with attachment fabric bands 91, thereby securing the straps 86 and 88.

Preferably the straps 86 and 88 are disposed in a crossed array as shown in FIG. 1 with each strap extending diagonally from its permanent attachment point on its respective side, at the shoulder location, to the lower abdomen of the infant. The straps can be secured together by attachment fabric bands such as 90. It is also preferred to provide a chest support in the form of pad 82 with attachment fabric band 83 to secure the pad 82 to coacting attachment fabric bands on the crossed straps 86 and 88.

The straps and bands of the sling are formed of flexible sheet material such as plastic sheeting and film, leather, or fabrics of woven fibers, such as cotton, Nylon, etc. Preferably, the bands are provided with suitable padding which can be laminated between opposite sides that are stitched or hemmed together at their edges or, alternatively, the bands could be entirely formed of a soft resilient plastic such a polyurethane or synthetic rubbers.

Figure 2:
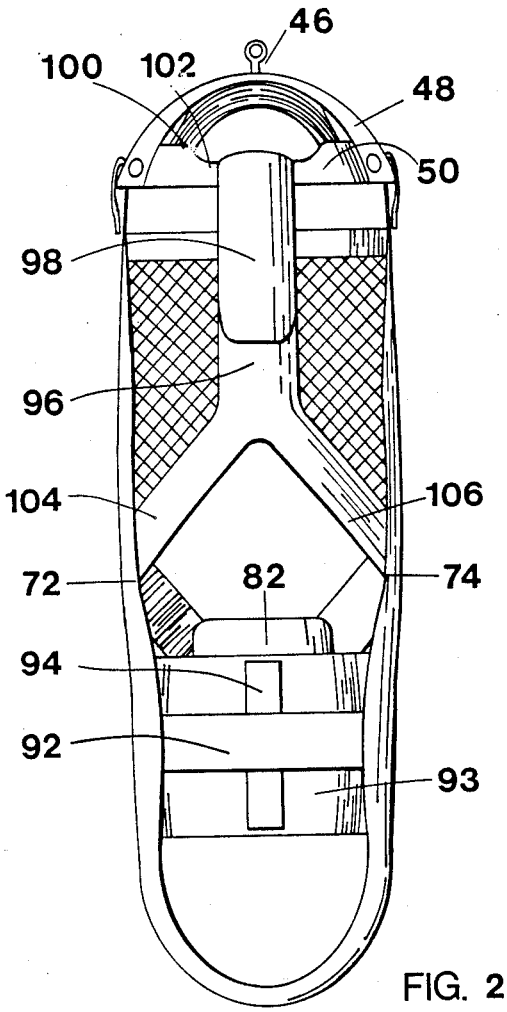
FIG. 2 is a rear view of the exerciser of FIG. 1.

Referring now to FIG. 2, the rear of the sling 54 is illustrated. The lower lumbar support can be seen to comprise a laterally extending rear belt 92 which is preferably elastic. Belt 92 is permanently attached, at its opposite ends, to the rear edges of the respective sides of the sling 54. The inside surface of this lateral belt preferably is covered with a fabric attachment band (not shown). The back support pad 93 has a coacting fabric attachment material 94 on its rear surface so that the pad can be removed and its position in the assembly adjusted. Suitable fabric attachment means for this purpose are the well known Velcro type fasteners which comprise coacting fabric bands of hook and loop fibers.

The upper end 96 of the rear support band 70 is illustrated in the attachment as passing about the supporting cylindrical ring 50 and looped downwardly and fastened to itself to form a loop 98 that receives the support ring 50. Preferably, for dimensional stability of the assembly, the upper edge 100 of the support ring has a recess 102 which locates the position of the rear band and prevents it from shifting from side to side. This variable attachment of the back support band 70 provide means for adjustment of the pitch, front-to-back, of the sling as the infant is tilted forward when the band 70 is shortened and tilted backward when the band 70 is lengthened. In its preferred embodiment, the rear support band 70 has an inverted Y-shape with lower diagonal extending ends 104 and 106 which project from approximately the middle of the upper shoulders of the infant, outwardly into joined attachment to the sides of the sling 54, approximately at the waist of the infant.

Figure 3:
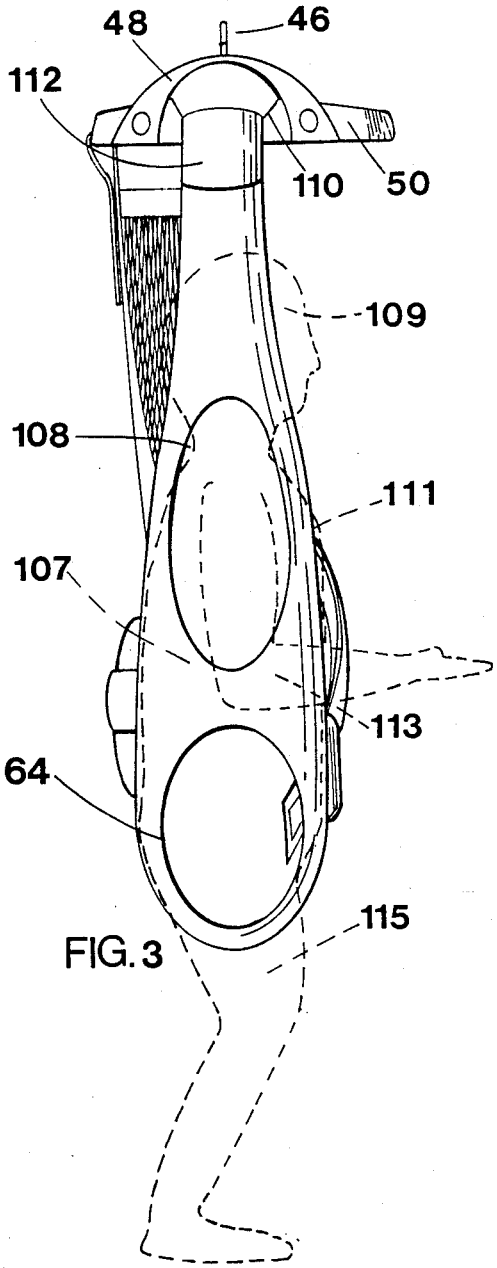
FIG. 3 is a side view of the exerciser of FIG. 1.

Referring now to FIG. 3, the structure of the sling 54 can be seen in greater detail. The outline of an infant 107 is shown in phantom lines with the infant's head 109 shown in relation to the protective ring 50, and with the infant's arms legs 115 extending through the leg openings such as 64 and the infant's arms 113 extending through the arm openings such as 108. As there illustrated, the leg openings 64 and 66 are in the lower bight 62 of the sling 54 and the arm openings 108 are shown in the sides of the sling 54. Preferably, the arm openings 108 are elliptically shaped, i.e., are elongated to provide a freedom of movement to the infant in the sling 54.

The support ring 50 also has a recess 110 at its opposite sides which is received within the looped end 112 of the sling band 56 thereby spatially locating the sides of the sling 54 and preventing shifting of these sides from front to back.

Figure 4:
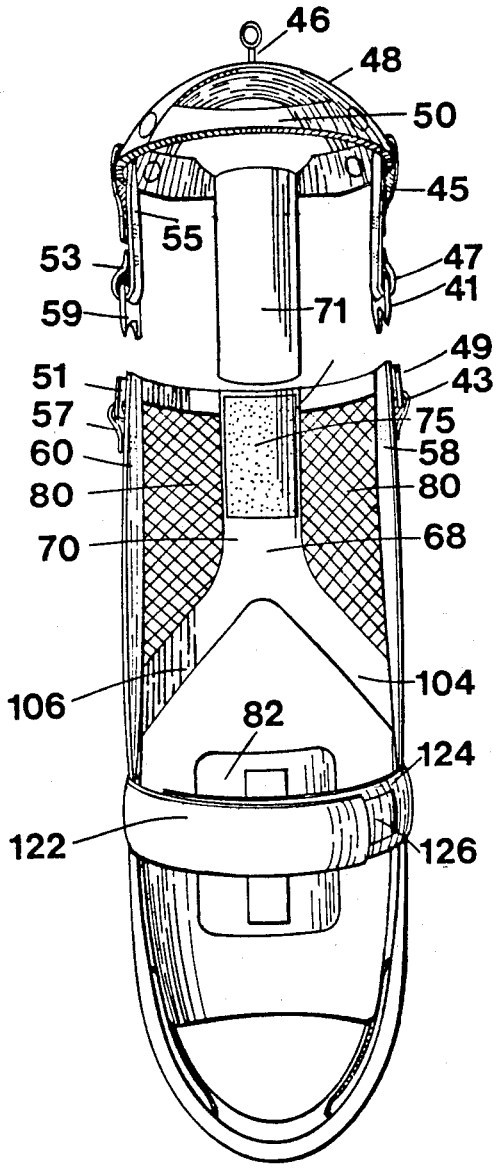
FIG. 4 is a front view of an alternative embodiment with a detachable sling.

FIG. 4 is a front view of an alternative embodiment of the sling of the invention. In this embodiment, the sling is detachable from the support ring, and is shown detached from the ring. For this purpose, the sling has a pair of buckles 49 and 51 which are secured in loops 43 and 57 located at opposite sides, on the upper ends 58 and 60 of the band 56. The ring 50 supports short straps 45 and 55 at its opposite sides, and coacting buckle tangs 41 and 59 are attached with strap loops 45 and 53 at the lower ends of these straps. The buckle tangs snap into the buckles 49 and 51 to secure the sling 54 to the support ring 50. The rear band 70 is also separated, with an upper portion 71 that is secured to the support ring 50, and a lower portion 73, which forms the back of the sling 54. A patch 75 of VELCRO attachment fabric is secured to the inside top surface of the lower back band portion 73 and a coacting patch (not shown) is secured to the outside lower end of the upper back band portion 71, thereby permitting support ring 50 to provide a detachable support of the back band portion 71.

The embodiment shown in FIG. 4 also has alternative front belting for the infant. In this embodiment, the front belting comprises straps 122 and 124, which are attached to the opposite front edges of the sides of the sling. The straps 122 and 124 are secured together with the fabric attachment bands such as 126.

If desired, a supplemental support pad or lining can be supplied with the sling. This lining can fit into the sling 54 as shown in FIG. 4 to partially fill the cavity within the sling and raise the leg openings so that the sling can fit very small infants.

Figure 6:
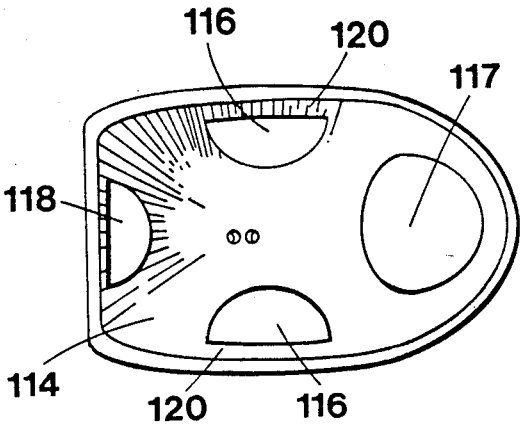
FIG. 6 is a view of the undersurface of the support plate of FIG. 5.
Figure 5:
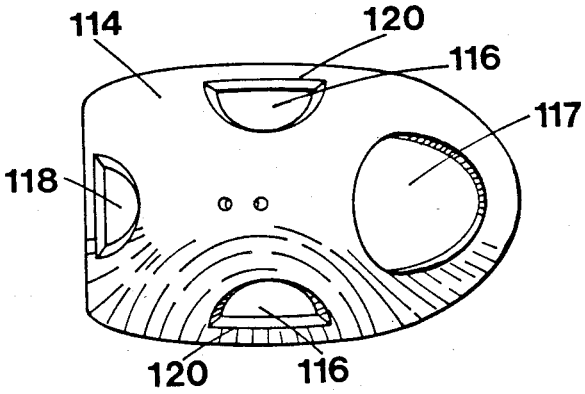
FIG. 5 is a top view of an upper support plate.

Referring now to FIGS. 5 and 6, there is illustrated an alternative embodiment for the upper support member of the invention. In this embodiment, the upper support member comprises a rigid dome 114 that centrally carries the support ring for the sling 54. FIGS. 5 and 6 are views of the top and lower surfaces, respectively, of the dome 114. Preferably, the dome 114 has a plurality of apertures 116 located laterally and an aperture 118 located at its rear. A ventilation hole 117 is also provided in the forward portion of the dome 114. The apertures 116 and 118 receive the looped ends of the side and rear bands of the sling 54. Preferably, for dimensional stability of the sling 54, the apertures in the dome are provided with substantially flat or horizontal sides such as 120 which will locate the looped ends of the sides and back and prevent them from shifting in the assembly. With this rigid dome, at least one of the two straps 40 and 34 is elastic, to provide the desirable degree of resilient "bounce" to the sling.

Figure 7:
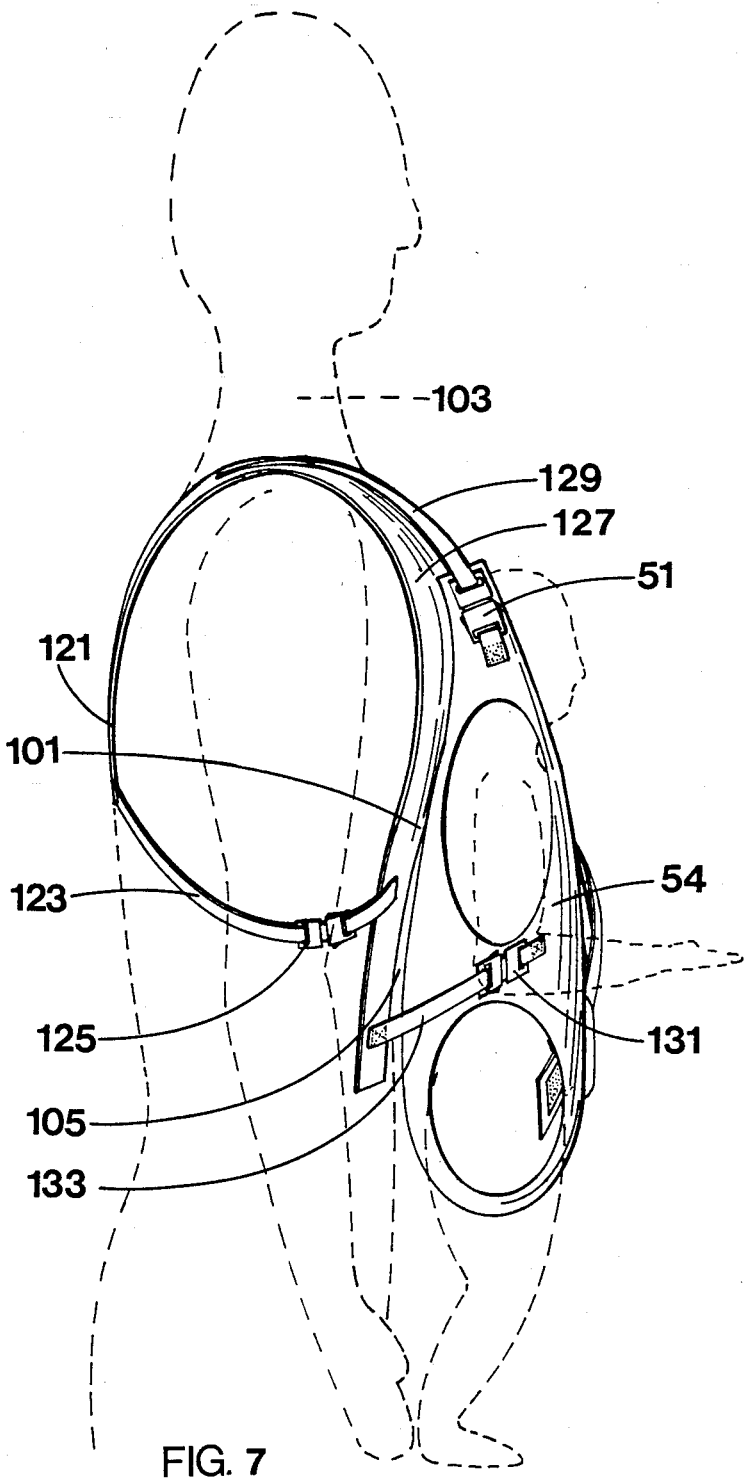
FIG. 7 is a view of the sling worn by an adult and used as an infant carrier.

Referring now to FIG. 7, the sling 54 is shown in use as an infant carrier. In this application, the detachable sling 54 shown in FIG. 4 is used. After detachment from the support ring 50, the sling 54 is secured to a vest 101 worn by an adult 103 (outlined in phantom lines). For this purpose, the vest 101 has a front panel 105 with shoulder bands such as 127 that are joined at the wearer's back, forming a V-back 121. Lateral straps 123 encircle the waist of the adult and are secured to the front panel 105 of the vest 101 with snap buckles 125. Right and left shoulder straps 129 are provided with snap tongs that are received in the buckles 49 and 51 (see also FIG. 4) which are attached to the upper ends of the sling 54. Additional snap buckles 131 are placed at opposite sides of the sling, between the arm openings and the leg openings. Lateral attachment straps such as 133 are permanently secured to the front panel 105 of the vest. Tongs, which are received in the buckles 131 are attached to the ends of these straps to secure the lower portion of the sling 54 to the vest 101.

The sling 54 of the invention provides a very stable support for the infant. The infant cannot tilt forward or backward in the sling, and cannot be thrown out of the sling 54 because the infant's arms and legs are received through apertures in the bottom and sides of the sling and in this position, the infant is securely belted in the sling by the front support belting. The elongated arm holes in the infant sling accommodate growth of the infant and extend the useful life of the sling from approximately three months to one year or more of the infant's age. The infant's head is totally enclosed by the sling assembly and is protected against striking side obstructions by the rigid ring 50. There is also no opportunity for the infant's head to extend laterally or rearwardly in the assembly which can lead to toppling or tilting, or to head injuries. Since the bands for the sling are formed of a suitably soft, resilient material such as plastic sheeting, fabrics such as cotton, nylon, etc., there is no opportunity for the infant to pinch its fingers between a rigid seat and door jambs. The sling of the invention thus provides a totally safe support or environment for the infant while not detracting from the enjoyment and use of its exercising capabilities.

The invention has been described with reference to the illustrated and presently preferred embodiment. It is not intended that the invention be unduly limited by this disclosure of the presently preferred embodiment. Instead, it is intended that the invention be defined by the means, and their obvious equivalents, set forth in the following claims.

What is claimed is:

1. A swing exerciser comprising:

a. a support frame;

b. a U-shaped sling formed of a unitary fabric band having a bottom with contiguous, integral and opposite sides formed by the upper ends of said fabric band which are attached to said support frame; with c. opposite leg apertures through said fabric band at said bottom of said sling;

d. an arm aperture through said fabric band at each of said sides;

e. a back support band extending downwardly from said support frame and secured to the rear edges of said sides at the lower portion of said sling; and f. front support means removably secured to said sides, whereby a user can be supported in said sling and secured therein with said sling enclosing the sides and back of the upper torso of the user and said front support means securely fastening said user in said sling.

2. The sling of claim 1 in combination with a rigid top frame with the upper ends of said fabric band and said back support band being secured to said rigid top frame.

3. The swing exerciser of claim 2 wherein said top frame is a support ring.

4. The swing exerciser of claim 2 wherein said upper ends of said fabric band and said support band are detachably secured, each to a respective connecting band, and wherein said connecting bands are secured to said support frame and the use of said sling as a carrier for an infant.

5. The swing exerciser of claim 1 wherein said opposite leg openings are in the bight of said U-shaped sling.

6. The swing exerciser of claim 1 wherein said back strap extends substantially parallel to said sides of said fabric band.

7. The swing exerciser of claim 1 wherein said front support means is a waist belt.

8. The swing exerciser of claim 3 wherein said support ring has a diameter substantially equal to an infant's lateral dimensions.

9. The swing exerciser of claim 1 wherein said fabric band has substantially parallel sides.

10. The swing exerciser of claim 1 wherein the back and sides of the upper torso of the infant are enclosed by said sling sides and said back support band.

11. The swing exerciser of claim 1 wherein the head and the back and sides of the upper torso of the user are enclosed by said sling sides and said back support band.

12. The swing exerciser of claim 1 wherein said front support means comprises a pair of straps extending from opposite corners, diagonally crossing each other across the front of the user.

13. The swing exerciser of claim 12 also including a chest support pad secured to the inside surfaces of said pair of straps, opposite the chest of the user.

14. The swing exerciser of claim 13 wherein said chest support pad is removably secured to said pair of straps.

15. The swing exerciser of claim 1 including a back support pad secured to the inside of said back support band.

16. The swing exerciser of claim 13 wherein said back support pad is removably attached to said back support band.

* * * * *